United States Patent [19]

Davidson et al.

[11] Patent Number: 4,515,077

[45] Date of Patent: May 7, 1985

[54] DUPLICATING STENCIL

[75] Inventors: Lewis Davidson, Woodford Green; Brian Lees, Hertfordshire; Eric K. Lytra, Enfield, all of England

[73] Assignee: Gestetner Manufacturing Limited, London, England

[21] Appl. No.: 515,151

[22] Filed: Jul. 19, 1983

[30] Foreign Application Priority Data

Jul. 22, 1982 [GB] United Kingdom ..... 8221249
Nov. 2, 1982 [GB] United Kingdom ..... 8231257

[51] Int. Cl.[3] ..... B41N 1/24

[52] U.S. Cl. ..... 101/127; 33/1 B; 33/1 G; 282/28 A; 283/1 R; 101/128.1; 101/DIG. 12

[58] Field of Search ..... 101/128.1, 114, D12, 101/127; 283/1 A, 1 R, 61; 400/703; 33/1 B, 1 G, 1 AA; 282/28 A

[56] References Cited

U.S. PATENT DOCUMENTS

| | | | |
|---|---|---|---|
| 833,713 | 10/1906 | Gestetner | 101/415.1 |
| 1,247,308 | 11/1917 | Meuser | 101/415.1 |
| 1,369,833 | 3/1921 | Murphy | 33/1 B |
| 1,575,718 | 3/1926 | Rogers | 101/128.1 |
| 1,771,563 | 7/1930 | Gestetner | 101/128.1 |
| 2,106,481 | 1/1938 | Giles | 101/128.21 |
| 2,201,953 | 5/1940 | Dalton | 101/128.1 |
| 2,203,280 | 6/1940 | Heath | 101/128.1 |
| 3,457,856 | 7/1969 | Rydberg | 101/128.1 |
| 4,123,087 | 10/1978 | Baron . | |
| 4,291,621 | 9/1981 | Thomas | 101/114 |
| 4,380,956 | 4/1983 | Elworthy | 101/383 |

FOREIGN PATENT DOCUMENTS

| | | | |
|---|---|---|---|
| 1187913 | 2/1965 | Fed. Rep. of Germany | 282/28 A |
| 2809929 | 9/1978 | Fed. Rep. of Germany | 101/127.1 |
| 1507628 | 11/1967 | France | 101/127 |

*Primary Examiner*—Clyde I. Coughenour
*Attorney, Agent, or Firm*—Fleit, Jacobson, Cohn & Price

[57] ABSTRACT

A duplicating stencil has its heading strip in the form of two separate regions separated by a perforation line.

The holes on one region have a different arrangement from those on the other regions, so that tearing along the perforation line allows one region to be separated from the rest of the stencil and to leave the holes of the remaining region as the effective mounting holes.

A single image field and a single top edge guide line apply for all of the heading strip regions.

12 Claims, 1 Drawing Figure

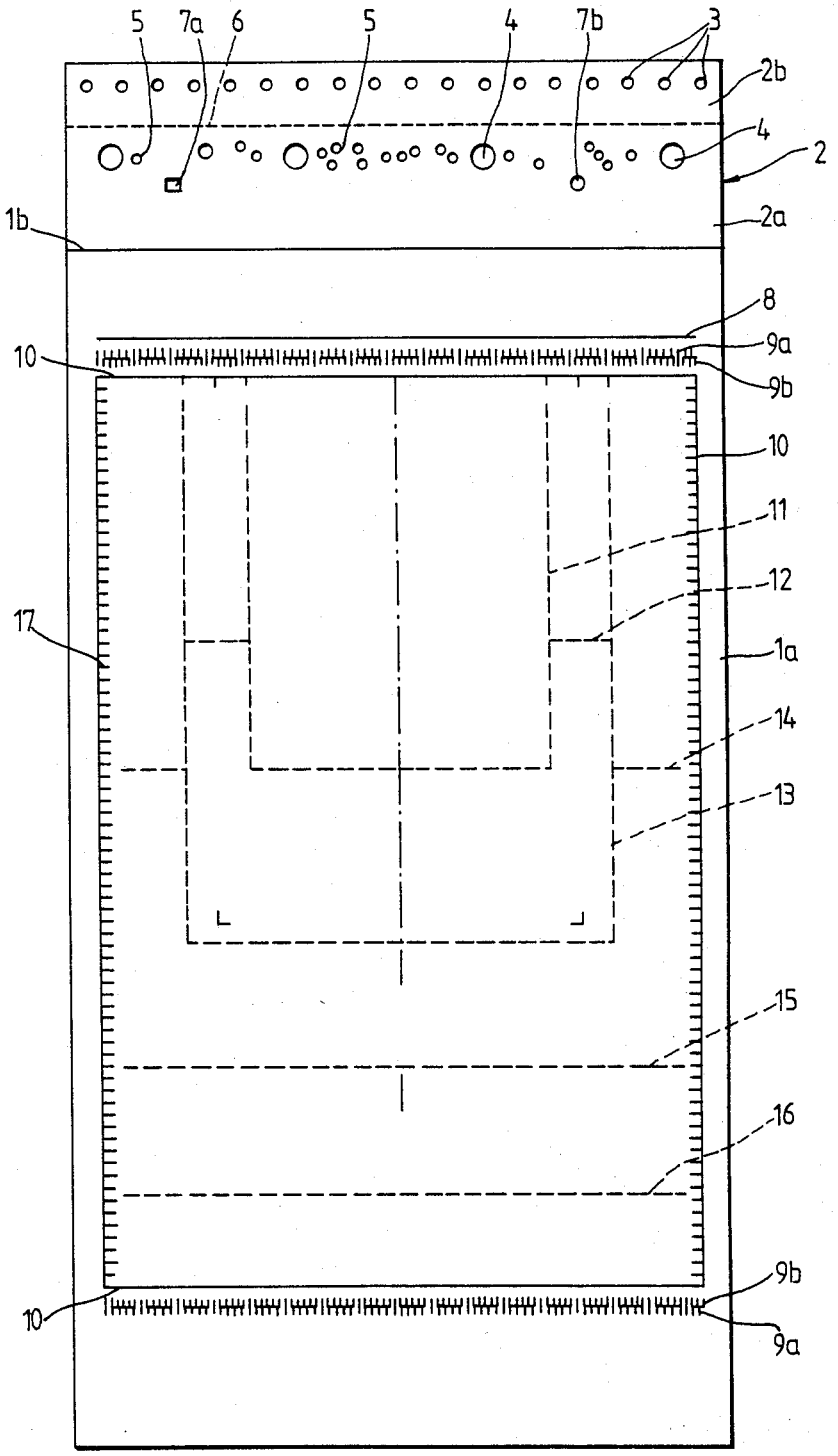
5
7a
6
5
4
7b
3
2b
4
2
1b
2a
8
9a
10
9b
10
11
12
17
1a
14
13
15
16
9b
10
9a

DUPLICATING STENCIL

DESCRIPTION

The present invention relates to a duplicating stencil, and in particular to the arrangement for fastening the stencil to a stencil carrier of a duplicator.

Conventional duplicating stencils comprise limp waxy material which, when selected areas thereof are exposed to spark discharge in an electronic stencil cutter or subjected to the action of heat in a thermographic stencil maker, or stamped mechanically by the type hammer of a typewriter, becomes ink-permeable in those areas (the so-called image areas). When the thus-imaged stencil is placed on a stencil carrier, ink passes through these permeable image areas but not through the remaining impermeable non-image areas and forms, on the back of the stencil, an ink image corresponding exactly to the permeability image of the stencil. That ink image from the back of the stencil is then pressed against a sheet of paper to be deposited on the paper as the resulting duplicated image.

In the past the stencil has been mounted on a duplicator by means of a cardboard or stiff paper so-called "stencil heading" strip which is fastened to the waxy image-receiving part of the stencil and is provided with holes to receive appropriate attachment pins of the stencil carrier of a duplicator.

Rotary duplicators have been known for over a hundred years and in that time several characteristic patterns of mounting pins have evolved. To some extent stencils are interchangeable so that one manufacturer's stencils can be mounted on another manufacturer's duplicator, but this interchangeability is not universal.

Conventionally, typing stencils have guide lines defining the areas of the stencil on which the image should be typed in order for the image to be correctly positioned on the copy sheet when that stencil is used on the duplicator for which it is intended. Although the duplicator usually has a print adjustment facility to enable the image to be moved up and/or down the copy sheet from a datum position, the guide line is intended to enable the typist to position the image correctly for printing when the print adjustment is set at the "0" or datum position.

Another problem arising in connection with stencil heading strips is that some machines have different "top spacing" distances between the mounting pins and the top edge of the image on the copy sheet (i.e. the position of the top edge of the image on the stencil in the neutral or "0" position of the print adjustment), and thus a stencil which is designed for use with one duplicator may not be acceptable for another one, purely from considerations of this "top spacing" unless the ranges of print adjustment are substantially identical.

In U.S. Pat. No. 4,291,621 it has been proposed that one stencil heading be formed as a plurality of separable strips each having punchings to mount the stencil on different machines of a range of duplicators, the unwanted strips being torn off before use of the stencil. However, because of the varying ranges of print adjustment peculiar to various existing popular duplicators the stencil disclosed in U.S. Pat. No. 4,291,621 had to be marked with several guide lines for the typist to use when positioning the image. This has the disadvantages that the typist can easily position her image on the wrong guide line, in error, and that the typist needs to know in advance on which particular duplicator any given stencil is to be used. Since U.S. Pat. No. 4,291,621 was aiming at the user who may have available various different brands of machine, the need for different guide lines was a major shortcoming which the present invention aims to overcome.

Accordingly, the present invention provides a duplicating stencil for use on more than one type of duplicator, comprising a sheet of limp stencil material which is printed with markings to assist the user to position the image correctly on the stencil and has attached along one edge a stencil heading strip defined as two heading strip regions separated by an intended line of separation of the heading strip regions, each of said heading strip regions being provided with a respective array of mounting holes, said intended line of separation being parallel to and spaced from said edge of the limp sheet, characterised in that said markings define an image field based on a single top edge of the copy sheet whereby the user, when positioning the image on the stencil before printing, does not need to choose from a range of different said top edges to suit a particular duplicator type.

Advantageously at least one of the heading strip regions has more than one array of mounting holes to allow said at least one heading strip region to be attached to more than one type of duplicator. Preferably, the demarcation line comprises a pre-scored or perforated line in the relatively stiff material of the heading strip.

Conveniently the stencil may include additional registration holes to assist the operator in correctly orienting the stencil with respect to the duplicator before attaching the stencil heading on the mounting pins.

In order that the present invention may more readily be understood, one embodiment of a stencil in accordance with the invention will now be described, merely by way of example, with reference to the accompanying drawings in which the sole FIGURE shows a preferred embodiment of the stencil of this invention in top plan view.

The duplicating stencil 1 illustrated in the drawing includes a limp stencil sheet 1*a* joined along a line 1*b* to a stiffer heading strip 2 which is defined as two separate, preferably rectangular, regions 2*a* and 2*b*. The stencil sheet 1*a* is printed with several grids defined by lines 10 to 17 inclusive (to be described later) to assist the typist in correctly positioning the image on the stencil.

The region 2*b* includes a straight line of regularly spaced holes 3 which are spaced at the I.S.O. standard stationary spacing distance (0.5 inch between centres). Manufacturers of stencil duplicators and stencils are currently being encouraged to adopt I.S.O. spacing for the mounting pins and holes on new equipment.

The region 2*a* has several different superimposed arrays of holes, the first of which comprises a line of four larger holes 4 regularly spaced along the heading strip region 2*a*. Preferably the spacing between these larger holes 4 is 2.6 inches between centres.

The heading strip region 2*a* includes a further array of holes 5 of three different sizes and of a characteristic layout which is intended to fit a corresponding array of pins on various models of Gestetner duplicators, including the Model 466, to engage some or all of these holes but in such a way that the stencil heading strip cannot be placed on the stencil clamp inverted (i.e. with the "back" surface of the stencil in contact with the ink screen).

The two stencil heading strip regions 2*a* and 2*b* are separated by a demarcation line 6, in this case a perforation line, which enables the region 2*b* to be torn from the region 2*a* if the various holes 4 and 5 are to be used for the mounting arrangement. The demarcation line 6 may instead be a pre-scored line in the stencil heading strip 2.

If the duplicator has its mounting pins at the I.S.O. spacing to conform with holes 3 of the region 2*b*, then that region 2*b* will be left attached to the region 2*a* and the stencil mounted in the normal way.

The region 2*a* includes two further holes 7*a* and 7*b* which are coded holes to ensure that, when using the regularly spaced holes 3 of region 2*b* or the regularly spaced holes 4 of region 2*a*, the stencil is not placed inverted. For this reason the lefthand hole 7*a* is of rectangular form and is generally larger than the righthand hole 7*b* of circular form. This coding of the stencil heading strip enables it to be used with a stencil loading device in accordance with our U.K. Patent Application No. 2122546A published Jan. 18, 1984.

Although, in the above description, the purpose of separating the stencil heading strip 2 into two separate rectangular regions 2*a* and 2*b* has been in order to allow completely dissimilar arrays of mounting holes to be formed on these two heading strip regions, it is of course within the scope of the present invention to rely on the use of the perforation line 6 in order to shorten the "top spacing", i.e. the distance between the array of mounting holes and the "top edge paper guide" line 8 of the stencil, even in a case where only one mounting hole configuration is used and is repeated on the two strip regions 2*a* and 2*b*. This will then allow for the same stencil mounting hole arrangement to be used on different machines which have considerable differences in the "top spacing" distance but with a single "top edge paper guide" line 8 for use with both heading strip regions 2*a* and 2*b*.

Because stencil duplicators are conventionally provided with an adjustment to allow the image to be moved upwardly or downwardly in relation to the sheet of paper, it is proposed in accordance with this invention that despite the fact that the "top spacing" considered with reference to the holes 3 on the one hand and the holes 4, 5 on the other hand will be different, the positioning of these holes and the perforation line 6 is chosen so that this difference in "top spacing" can be taken up within the normal range of print adjustment of the duplicators involved.

The configuration shown in the drawing may be modified by providing more than two such heading strip regions, for maximum versatility of the stencil.

The image field, based on the single "top edge paper guide" line 8, is defined by a large rectangular grid 10 having a length of 317 mm (measured in a direction perpendicular to the "top edge paper guide" line 8) and a width of 210 mm (measured in a direction parallel to the "top edge paper guide" line 8). The upper transverse edge of the grid 10 (the one closer to the guide line 8) is spaced from the line 8 by a distance of 13 mm. This is to allow for clamping means on the duplicator to pick up the copy sheet and carry it through the printing nip between the cylinder and an impression roll and consequently it is intended that there should be no image in that particular 13 mm wide strip across the top of the copy sheet.

The overall width of the grid 10 is equivalent to the width of an A4 sheet, and the grid 10 is positioned with its bottom transverse edge spaced from the line 8 by the length of a legal foolscap sheet (330 mm).

Across the top of the limp stencil sheet 1*a*, in the dead space between the line 8 and the nearer of the two edges of the grid 10 which are parallel thereto are two sets of markings 9*a* and 9*b* which indicate, respectively, the number of characters across the image field for pica type face and elite type face.

The centrally arranged small grid 11 in the image field corresponds to an A6 copy sheet extending lengthwise of the stencil. The grid 12 indicates the positioning of an A6 sheet positioned transversely across the stencil.

Likewise, the medium-sized grid 13 represents the arrangement of an A5 sheet lengthwise of the stencil while the grid 14 illustrates the positioning of an A5 sheet transversely across the stencil.

The line 15 marks the bottom of a 10 inch copy sheet (254 mm in length) whereas the line 16 depicts the bottom edge of an A4 sheet.

Likewise, the corner markings 17 illustrate the bottom corners of a sheet measuring 8 inches by 5 inches (204 mm by 127 mm).

Finally, at the very bottom of the stencil sheet 1*a*, outside the field grid 10 is a further set of type character gradation lines 9*a* and 9*b* for pica and elite, respectively.

It must be understood that although there are various different grids to correspond to different sizes of image in the field grid 10, each of these grids is based on the common "top edge paper guide" line 8 as in the case of a conventional stencil.

Thus, to the typist, the stencil in accordance with the present invention presents no undue problems as he or she simply aligns the image with whichever of the various copy sheet size grids would be used on a conventional stencil. This is considered a very important advantage of the multi-heading stencil according to the present invention and provides for the possibility of having all stencils typed without any reference to the particular heading strip 2*a* or 2*b* which is to be used to mount the stencil on a duplicator, so that once that stencil is to be printed the user of the duplicator simply takes up any image mispositioning by use of the normal print adjustment control on the duplicator. Clearly, given various different types of duplicators available in a given enterprise, the stencils may all be in accordance with the present invention and thus, once the print adjustment of any one of those duplicators has been set for the stencil in accordance with the invention there is no need for further adjustment provided (as with a conventional single heading stencil) the typist correctly positions the image with reference to the guide line 8 by using the appropriate positioning grid 10, 11, 12, 13 or 14. All the operator needs to be careful of is that he or she tears off the strip 2*b*, or not as the case may be, and uses the line of mounting holes 3 or 4, 5 appropriate to the particular duplicator being used.

Since the optimum position for the stencil on the ink screen is a function of the design of the stencil clamp, and the optimum position of the image on the stencil is furthermore dictated by the copy sheet gripper system on the impression roll, it turns out in practice that the "zero" position of the print adjustment is not in the centre of the range. In fact it is possible, given a stencil which has the image based on the "top edge paper guide" line 8 for the stencil to be adjusted upwardly by 3.9 cm (9 lines of print) or downwardly by 1.3 cm (3 lines of print). This particular range of adjustments is applicable to a Gestetner 466 duplicator and to many other Gestetner duplicators, and is interesting because it provides sufficient latitude to accommodate not only different Gestetner machines, but also machines of other manufacturers, provided the lines of holes 3, 4 and 5 are chosen appropriately.

For example, if a conventional Gestetner stencil is to be used on a Rex-Rotary machine the typist would, for optimum results, position the image with the top edge of the image just below line "5" whereas for a Gestetner duplicator the typist would use line "zero". If, therefore, a single zero line were produced at the position which is applicable for the Rex-Rotary stencil, then the ability of the Gestetner machine to raise the image by up to 9 lines of print (i.e. well over the 5 lines required to accommodate the mismatch between Rex-Rotary and Gestetner), will keep the image correctly positioned on a copy sheet printed on a Gestetner machine. The same theory applies to machines of other manufacturers. However, by appropriate choice of the positioning of the perforation line between heading strip region 2*a* and heading strip 2*b* it is furthermore possible to take up some or all of this mismatch (for example by placing the punchings corresponding to the machine having the larger "top spacing" further from the limp stencil 1*a* than is the line of punchings corresponding to the machine with the shorter top spacing).

We claim:

1. A duplicating stencil for use on more than one type of duplicator, comprising: a sheet of limp stencil material having first and second edges; printed markings on said sheet to assist the user in positioning the image correctly on the stencil based upon the size of a paper sheet to which the image is to be transferred during duplication; a stencil heading strip attached along said first edge of said sheet and defined as first and second heading strip regions separated by an intended line of separation of the heading strip regions, said first and second heading strip regions each having a plurality of differently configured apertures defining a respective array of mounting holes in each of said regions for mounting said stencil on any of several duplicators having different mounting post configurations and patterns, said intended line of separation being parallel to and spaced from said first edge of the limp sheet; said printed markings defining a plurality of image fields having a common printed top edge line for aligning material to be duplicated relative to an edge of the copy sheet to be printed, said common printed top edge line spaced from said heading strip, whereby the user can position the image to be duplicated with reference to said common top edge line and does not need to choose from a range of different said top edges for respective different duplicators when positioning the image on the stencil before printing.

2. A stencil according to claim 1, and including a third heading strip region at said first edge of said sheet of limp stencil material, said third heading strip region being contiguous to and readily removable from said second heading strip region along an additional intended line of separation.

3. A stencil according to claim 1, wherein each said line of intended separation is a marked demarcation line defining a line of mechanical weakness.

4. A stencil according to claim 3, wherein each said demarcation line is defined by a line of perforations.

5. A stencil according to claim 3, wherein each said demarcation line is a pre-scored line.

6. A stencil according to claim 1, wherein at least one of said heading strip regions has more than one array of mounting holes to allow said at least one strip region to be attached to more than one type of duplicator.

7. A stencil according to claim 6, wherein at least one of said arrays of mounting holes is arranged to prevent attachment of the stencil to a stencil carrier with the stencil carrier in contact with that face of the stencil which is intended to face outwardly for printing purposes.

8. A stencil according to claim 7, and further including a set of coding holes on at least one of said stencil heading strip regions, said coding holes being effective to prevent attachment of the stencil to the stencil carrier with the ink screen in contact with that face of the stencil which should face outwardly for normal printing.

9. A stencil according to claim 6, and further including a set of coding holes on at least one of said stencil heading strip regions, said coding holes being effective to prevent attachment of the stencil to the stencil carrier with the ink screen in contact with that face of the stencil which should face outwardly for normal printing.

10. A stencil according to claim 1, wherein at least one hole of each of said arrays of mounting holes is of a different cross-sectional configuration to prevent attachment of the stencil to a stencil carrier with the stencil carrier in contact with that face of the stencil which is intended to face outwardly for printing purposes.

11. A stencil according to claim 10, and further including a set of coding holes on at least one of said stencil heading strip regions, said coding holes being effective to prevent attachment of the stencil to the stencil carrier with the ink screen in contact with that face of the stencil which should face outwardly for normal printing.

12. A stencil according to claim 1, and further including a set of coding holes on at least one of said stencil heading strip regions, said coding holes being effective to prevent attachment of the stencil to the stencil carrier with the ink screen in contact with that face of the stencil which should face outwardly for normal printing.

* * * * *